United States Patent [19]

De Visser et al.

[11] 4,032,449

[45] June 28, 1977

[54] SKIMMER FOR A BODY OF LIQUID WITH FLOATING SOLIDS

[75] Inventors: Erik V. M. De Visser; Karel I. Ghyselen, both of De Pinte, Belgium

[73] Assignee: S.A. Texaco Belgium N.V., Brussels, Belgium

[22] Filed: Mar. 24, 1976

[21] Appl. No.: 669,775

[52] U.S. Cl. ..... 210/173; 210/DIG. 25; 210/242 R

[51] Int. Cl.² ..... E02B 15/04

[58] Field of Search ..... 210/161, 162, 242, 519, 210/520, 523, 525, 173, 174

[56] References Cited

UNITED STATES PATENTS

| | | | |
|---|---|---|---|
| 1,709,783 | 4/1929 | Etheredge | 210/242 R |
| 2,146,542 | 2/1939 | Hawley | 210/242 R |
| 2,778,500 | 1/1957 | Fuller | 210/523 X |
| 3,204,773 | 9/1965 | Lind | 210/525 |
| 3,880,758 | 4/1975 | Galacia | 210/242 R |

*Primary Examiner*—Theodore A. Granger
*Attorney, Agent, or Firm*—Thomas H. Whaley; Carl G. Ries; Henry C. Dearborn

[57] ABSTRACT

Skimmer apparatus for a pond or reservoir where the surface layer contains frangible solid matter. It employs a weir structure with a curved edge, and a pair of arms having interlocking teeth extending radially from the edge. One arm is stationary and one rotates so that the interlocking positions of the teeth will break up the solid matter.

4 Claims, 2 Drawing Figures

SKIMMER FOR A BODY OF LIQUID WITH FLOATING SOLIDS

BACKGROUND OF THE INVENTION

1. Field of the Invention

This invention concerns skimmer apparatus in general, and particularly relates to a liquid surface skimmer which is useful in dealing with floating solid matters on the surface of a liquid body that is being skimmed.

2. Description of the Prior Art

Heretofore there have been many different types of apparatus proposed for use in skimming the surface fluids from a body of liquid. Such prior systems have included arrangements for adjusting the depth of surface skimming action. They have also included apparatus for causing agitation of the surface from beneath, with a recycled fluid in order to assist in directing the surface material being skimmed into a skimmer receptacle. However, there has been no known provision for accomodating and overcoming the difficulty that arises where there is present on the surface to be skimmed an accumulation of floating semi-solid materials which tend to form into lumps. Such lumps will be skimmed and thereafter tend to clog the drainage system for the skimmed fluid.

Consequently, it is an object of this invention to provide an improved skimmer that includes apparatus for effectively breaking up lump-forming solid matters that are floating on the surface being skimmed.

SUMMARY OF THE INVENTION

Briefly, the invention concerns a skimmer for use on a body of liquid subject to having solid matter floating on the surface thereof. It comprises in combination weir means for drawing off liquid from the surface of said body of liquid, and means for adjustably supporting said weir means vertically relative to said surface. It also comprises tooth means for breaking up solids having greater than a predetermined size and tending to be carried over said weir means with said liquid being drawn off.

Again briefly, the invention concerns a skimmer for use on a body of water subject to having solid matter floating on the surface thereof being skimmed. The skimmer comprises in combination a circular edged weir means having a funnel associated therewith for directing skimmed fluid away from said body of water, and a framework for supporting said weir means and being adapted for hanging support in said body of water. It also comprises buoyancy means attached to said framework for supporting a portion of the load, and counter weight means associated with said hanging support for supporting the remainder of the load with said weir means at a predetermined depth. It also comprises a first pair of diametrically situated stationary supports mounted on said framework concentrically with said circular weir means and at the surface of said body of water. In addition, it comprises a set of upstanding teeth on each of said pair and each set extending radially into said body of water upstream of said weir edge, and a second pair of diametrically situated rotatable supports mounted on said framework concentrically with said circular weir means and above the surface of said body of water. It also comprises a set of downwardly extending teeth on each of said second pair and each set extending radially as far as said sets of upstanding teeth, and said downwardly extending teeth being located spaced radially between and vertically overlapping said upstanding teeth. It also comprises motor means mounted on said framework for rotating said second pair of rotatable supports.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings wherein.

DESCRIPTION OF THE PREFERRED EMBODIMENT

Figures 1, 2:
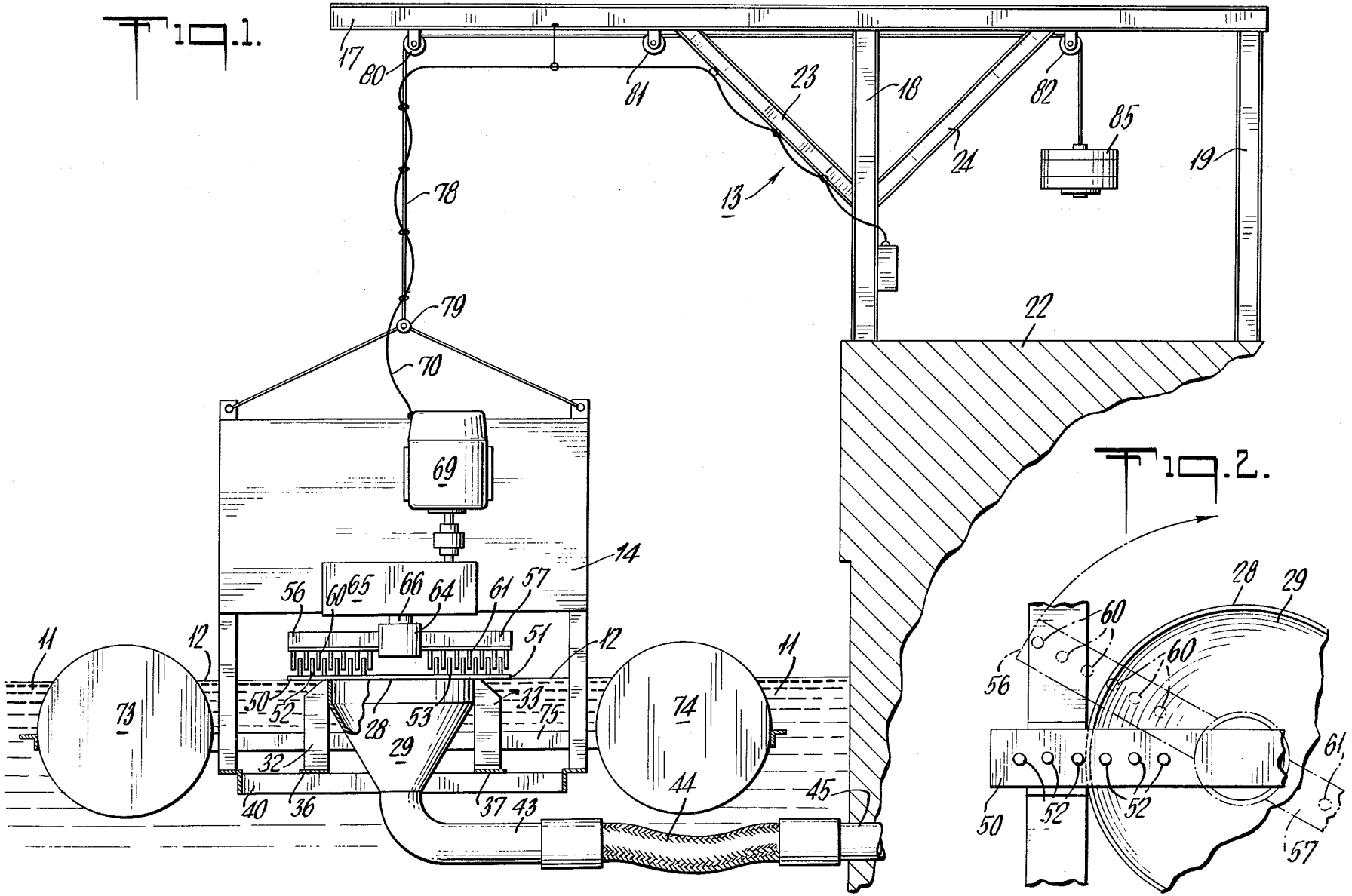
FIG. 1 is a schematic side elevation view partly in cross-section, illustrating a skimmer according to the invention.
FIG. 2 is a fragmentary plan view showing the stationary and indicating the rotating teeth by dashed lines. These are the solids break up elements, and they are shown in relation to the weir element of the skimmer.

As indicated above, this invention has as its primary function the ability to overcome the problem which has been found in connection with skimming of a body of liquid where the surface fluid being skimmed may include substantial amounts of solid materials in the form of floating lumps. Such lumps tend to be skimmed off and taken into the drainage system, where they rapidly clog same until the skimmer becomes ineffective. This invention provides for breaking up all such lumps of solid materials into small enough pieces so that they may all be drawn off and disposed of without clogging the system that drains the skimmed fluid.

Referring to the FIGS. of the drawing it will be noted that, as illustrated, the apparatus is particularly adapted for use in skimming a body of liquid, e.g. water 11. This body may be a pond or reservoir where the liquid 11 is being collected, and which has a light surface component 12 which is to be skimmed off.

Situated on one side of the pond or reservoir 11 there is a support 13 for a framework 14. Framework 14 hangs from a cantilever beam 17 which extends horizontally out over the pond 11. The beam 17 is attached to a pair of legs or supporting beams 18 and 19, that are mounted in or on a concrete or similar type of sidewall structure 22. Also there are angle braces 23 and 24 for giving proper support to the cantilever beam 17.

There is a circular edged weir 28 that is formed by the top edge of a funnel 29 which is supported on the framework 14 in any feasible manner. As illustrated, the funnel 29 is mounted centrally between two diametrically situated vertical braces 32 and 33. These extend upward from a pair of cross supports 36 and 37 respectively, which are attached to opposite sides of a lower rectangular framework 40 that is part of the overall framework 14.

The bottom of the funnel 29 has a conduit 43 connected therewith, which in turn is coupled to a flexible hose or similar flexible conduit section 44 that in turn connects to a conduit 45 which leads to an appropriate means for disposal (not shown) as required.

It has been found that where the body of liquid being skimmed includes liquids such that the surface component 12, to be drawn off, has accumulations of relatively solid matter in the form of lumps, these lumps tend to be drawn off with the surface fluid being skimmed. Such lumps then gather together in the conduit where the skimmed liquid is being drawn away so that they rapidly collect and form a solid plug which then stops the effectiveness of the skimmer.

In order to overcome the foregoing problem, there has been provided a pair of diametrically situated stationary support members 50 and 51, which each have a set of upstanding teeth 52 and 53 respectively mounted thereon. Each of these sets of teeth extend radially from the center of the circular weir 28 beginning well inside of the weir edge 28 and continuing out on the upstream side for a substantial distance. It will be noted that these support members 50 and 51 are located at the surface or slightly there beneath so that the sets of teeth 52 and 53 extend upward above the surface component 12 of the body of water 11.

For breaking up the solid material lumps, there is a cooperating rotatable pair of diametrically situated support arms 56 and 57. These arms each have a set of downwardly extending teeth 60 and 61 respectively, that are mounted with individual radial spacings so as to alternate with and fit between the corresponding sets of upstanding teeth 52 and 53. The arms 56 and 57 are attached to a hub 64 that is rotatable by the output from a gear box 65, via a short shaft 66. The power for driving the gear train in the gear box 65 is supplied by an electric motor 69 and the electric power for this motor is delivered via a cable 70.

In order to provide for the depth of the skimming action to be adjustable, the framework 14 of the skimmer is partially supported by a plurality of floats 73 and 74. These floats are attached to the framework 14 in any feasible manner, e.g. by an indicated cross beam 75. These floats 73 and 74 are designed so as not to provide sufficient flotation to carry the entire weight of the skimmer 14. Consequently, the remainder of the load is carried by a supporting line or cable 78 that runs upward from an eye ring 79 and over a pulley 80 that is attached near the free end of the cantilever beam 17. At the pulley 80 the cable 78 changes direction to run horizontally through a guide pulley 81 to another direction changing pulley 82. Then it is attached to a counterweight 85 that may be adjusted in regard the amount of weight which is included. In this manner the equilibrium position of the skimmer framework 14 and all the elements mounted thereon, will be adjustable with relation to the depth of the surface component 12 of the body of water 11.

Operation

When the skimmer is placed in operation the depth of skimming action is determined by adjusting the amount of weight on the counter weight 85, so that a given depth of surface liquid 12 will be flowing over the weir edge 28. Then, as soon as the surface liquid 12 begins to flow over the weir edge 28 (of the funnel 29) and out through the disposal conduit 43, the motor 69 is energized so that the arms 56 and 57 with their downwardly extending sets of teeth 60 and 61 are rotated in a continuous manner. This causes these teeth 60 and 61 to describe circular paths which are parallel to the weir edge 28. These arms will be rotated fast enough to be sure to encounter any floating solid material lumps and sweep them around peripherally outside of weir 28 until the teeth reach and pass between the upstanding sets of teeth 52 and 53. That will, of course, break up the solid lumps into small enough particles so that they will not cause clogging of the outflow of skimmed liquid.

The combination of elements according to this invention provides for an effective operation to avoid the clogging action which has been found to take place where solid lumps (especially in cold weather) are found floating on the surface of the skimmer liquid. It will be understood that the liquid skimmed off may be pumped (not shown) or otherwise caused to flow from the bottom of the funnel in a conventional manner.

While a particular embodiment of the invention has been described in considerable detail in accordance with the applicable statutes, this is not to be taken as in any way limiting the invention but merely as being descriptive thereof.

We claim:

1. A skimmer for use on a body of liquid subject to having solid matter floating on the surface thereof, comprising in combination a circular edged weir formed by the upper edge of a funnel immersed in said body of liquid, means for supporting said funnel with said weir at an adjustable depth beneath the surface of said body of liquid, and dynamic means for breaking up solids having greater than a predetermined size and tending to be carried over said weir edge, comprising a first set of spaced teeth mounted on a pair of diametrically situated stationary supports relative to said funnel, said teeth extending vertically upward from said supports, said supports extending radially relative to said weir edge and being situated adjacent to said surface of the body of liquid, and a second set of spaced teeth mounted on a complementary pair of diametrically situated rotatable supports extending radially in a concentric manner relative to said first set supports, said second set of teeth extending vertically downward and radially between said first set, and conduit means connected to the bottom of said funnel for carrying off the skimmed fluids.

2. A skimmer according to claim 1, wherein said means for adjustably supporting comprises buoyancy means for supporting part of the load, and adjustable vertical thrust means for supporting the remainder of the load.

3. A skimmer according to claim 2, further comprising means for rotating said pair of rotatable supports.

4. A skimmer for use on a body of water subject to having solid matter floating on the surface thereof being skimmed, comprising in combination a circular edged weir formed by a funnel associated with said skimmer for directing skimmed fluid away from said body of water, a framework for supporting said weir edged funnel and being adapted for hanging in said body of water, buoyancy means attached to said framework for supporting a portion of the load, counterweight means associated with said hanging support for supporting the remainder of the load with said weir at a predetermined depth in said body of water, a first pair of stationary supports mounted on said framework and extending diametrically across said weir edge of said funnel concentrically with said circular weir edge and at the surface of said body of water, a set of upstanding teeth on each of said first pair and each set extending radially into said body of water upstream of said weir edge, a second pair of rotatable supports mounted on said framework and extending diametrically across said weir edge of said funnel concentrically with said circular weir edge and above the surface of said body of water, a set of downwardly extending teeth on each of said second pair and each set extending radially as far as said sets of upstanding teeth, said downwardly extending teeth being located spaced radially between and vertically overlapping said upstanding teeth, motor means mounted on said framework for rotating said second pair of rotatable supports and conduit means connected to the bottom of said funnel for carrying off the skimmed fluids.

* * * * *